US009449740B2

(12) United States Patent
Eshima et al.

(10) Patent No.: US 9,449,740 B2
(45) Date of Patent: Sep. 20, 2016

(54) ELECTRIC CABLE

(71) Applicant: HITACHI METALS, LTD., Tokyo (JP)

(72) Inventors: Hirotaka Eshima, Hitachi (JP); Fumihito Oka, Hitachi (JP); Nobuyuki Yamashita, Hitachi (JP); Takahiro Futatsumori, Mito (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 14/492,457

(22) Filed: Sep. 22, 2014

(65) Prior Publication Data

US 2015/0083482 A1 Mar. 26, 2015

(30) Foreign Application Priority Data

Sep. 26, 2013 (JP) ..... 2013-200472

(51) Int. Cl.

| | |
|---|---|
| ***H01B 11/04*** | (2006.01) |
| ***H01B 11/10*** | (2006.01) |
| ***H01B 7/18*** | (2006.01) |
| *H01B 7/04* | (2006.01) |

(52) U.S. Cl.

CPC ..... *H01B 11/1033* (2013.01); *H01B 7/182* (2013.01); *H01B 7/04* (2013.01)

(58) Field of Classification Search

CPC ..... H01B 11/04; H01B 7/17; H05K 9/009; H05K 9/0098

USPC ..... 174/34, 393

See application file for complete search history.

(56) References Cited

U.S. PATENT DOCUMENTS

| | | | | |
|---|---|---|---|---|
| 4,641,110 | A | 2/1987 | Smith | |
| 5,414,211 | A * | 5/1995 | Chan | 174/36 |
| 7,288,494 | B2 * | 10/2007 | Iwasaki | H05K 9/0098 139/425 R |
| 2005/0211082 | A1 * | 9/2005 | Angeloni et al. | 87/3 |
| 2013/0299211 | A1 * | 11/2013 | Pope | 174/113 R |
| 2014/0202756 | A1 | 7/2014 | Adachi et al. | |
| 2014/0348476 | A1 * | 11/2014 | Arao | G02B 6/4403 385/103 |

FOREIGN PATENT DOCUMENTS

| | | | |
|---|---|---|---|
| JP | S55-29065 | | 8/1978 |
| JP | 8-315648 | A | 11/1996 |
| JP | 2006-031954 | A | 2/2006 |
| JP | 2006-164830 | A | 6/2006 |
| JP | 2006-351322 | A | 12/2006 |
| JP | 2013-74650 | A | 4/2013 |

OTHER PUBLICATIONS

Perumalraj et al. "Electromagnetic shielding Effectiveness of Copper Core Yarn Knitted Fabrics", Indian Journal of Fibre & Textile Research, vol. 34, Jun. 2009, pp. 149-154.*

Japanese Notification of Reason(s) for Refusal dated Aug. 2, 2016 received from Japanese Application No. 2013-200472, together with an English-language translation.

* cited by examiner

*Primary Examiner* — Hoa C Nguyen
*Assistant Examiner* — Stanley Tso
(74) *Attorney, Agent, or Firm* — Scully, Scott, Murphy & Presser, P.C.

(57) ABSTRACT

An electric cable includes a conductor core including conductors each covered with an insulation layer, and a braided layer formed on an outer periphery of the conductor core. The braided layer includes a braid of a first line group and a second line group. The first line group includes first metal lines and first fiber lines arranged along a longitudinal direction of the conductor core and is spirally wound around the outer periphery of the conductor core. The second line group includes second metal lines and second fiber lines arranged along the longitudinal direction of the conductor core and is spirally wound around the outer periphery of the conductor core in a direction opposite to the first line group.

6 Claims, 4 Drawing Sheets

ELECTRIC CABLE

The present application is based on Japanese patent application No. 2013-200472 filed on Sep. 26, 2013, the entire contents of which are incorporated herein by reference.

BACKGROUND OF THE INVENTION

1. Field of the Invention

The invention relates to an electric cable and, in particular, to an electric cable used for automobiles etc.

2. Description of the Related Art

An electric cable provided with e.g. a conductor core and a shield layer formed by braiding metal wires to cover the outer periphery of the conductor core is known as an electric wire used for automobiles etc. (see JP-A-2006-031954). It is possible to improve the electrical shielding properties of the electric cable by using the shield layer. Another electric cable is also known which is provided with e.g. a conductor core and a hybrid braid layer formed by alternately weaving metal wires and fibers to cover the outer periphery of the conductor core (see JP-A-2006-351322). It is possible to improve the tensile strength and flex resistance of the electric cable by using the hybrid braid layer.

SUMMARY OF THE INVENTION

The electric cable disclosed in JP-A-2006-351322 may be better in tensile strength and flex resistance but be poorer in shielding properties than the electric cable disclosed in JP-A-2006-031954.

It is an object of the invention to provide an electric cable that meets the improved shielding properties as well as the excellent tensile strength and flex resistance.

(1) According to one embodiment of the invention, an electric cable comprises:

a conductor core comprising conductors each covered with an insulation layer; and a braided layer formed on an outer periphery of the conductor core, wherein the braided layer comprises a braid of a first line group and a second line group, wherein the first line group comprises first metal lines and first fiber lines arranged along a longitudinal direction of the conductor core and is spirally wound around the outer periphery of the conductor core, and wherein the second line group comprises second metal lines and second fiber lines arranged along the longitudinal direction of the conductor core and is spirally wound around the outer periphery of the conductor core in a direction opposite to the first line group.

In the above embodiment (1) of the invention, the following modifications and changes can be made.

(i) The first line group further comprises a first line bundle group that comprises first metal line bundles and first fiber line bundles alternately arranged along the longitudinal direction of the conductor core and is spirally wound around the outer periphery of the conductor core, the first metal line bundle being a bundle of a plurality of the aligned first metal lines and the first fiber line bundle being a bundle of a plurality of the aligned first fiber lines, wherein the second line group further comprises a second line bundle group that comprises second metal line bundles and second fiber line bundles alternately arranged along the longitudinal direction of the conductor core and is spirally wound around the outer periphery of the conductor core in the direction opposite to the first line bundle group, the second metal line bundle being a bundle of a plurality of the aligned second metal lines and the second fiber line bundle being a bundle of a plurality of the aligned second fiber lines, and wherein the braided layer further comprises a braid of the first line bundle group and the second line bundle group.

(ii) The first line group further comprises a first composite line bundle group that comprises a plurality of first composite line bundles arranged along the longitudinal direction of the conductor core and is spirally wound around the outer periphery of the conductor core, the first composite line bundle being a bundle formed by aligning a plurality of the first metal lines and a plurality of the first fiber lines, wherein the second line group further comprises a second composite line bundle group that comprises a plurality of second composite line bundles arranged along the longitudinal direction of the conductor core and is spirally wound around the outer periphery of the conductor core in the direction opposite to the first composite line bundle group, the second composite line bundle being a bundle formed by aligning a plurality of the second metal lines and a plurality of the second fiber lines, and wherein the braided layer further comprises a braid of the first composite line bundle group and the second composite line bundle group.

(iii) The first fiber lines are arranged at both ends in a width direction of the first composite line bundle, and wherein the second fiber lines are arranged at both ends in a width direction of the second composite line bundle.

(iv) A diameter of the first fiber lines arranged at the both ends in the width direction of the first composite line bundle is larger than a diameter of the first metal lines arranged widthwise inside the first fiber lines, and wherein a diameter of the second fiber lines arranged at the both ends in the width direction of the second composite line bundle is larger than a diameter of the second metal lines arranged widthwise inside the second fiber lines.

(v) The first composite line bundle further comprises a plurality of the first metal lines and the first fiber lines are interposed therebetween, and wherein the second composite line bundle comprises a plurality of the second metal lines and the second fiber lines are interposed therebetween.

Effects of the Invention

According to one embodiment of the invention, an electric cable can be provided that meets the improved shielding properties as well as the excellent tensile strength and flex resistance.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

First Embodiment of the Invention

The configuration of the electric cable in the first embodiment will be described below in reference to the drawings.

Figure 1A:
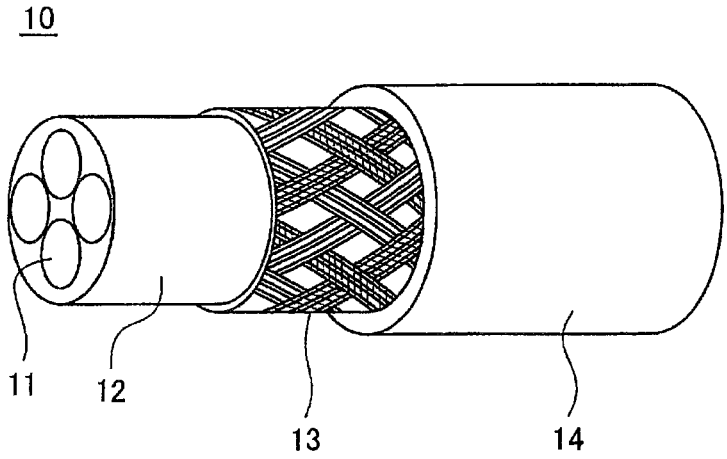
FIG. 1A is a perspective view showing an electric cable in a first embodiment of the present invention.

As shown in FIG. 1A, an electric cable 10 in the first embodiment is provided with a conductor core 11 and a braided layer 13 formed on the outer periphery of the conductor core 11. An inclusion 12 is provided between the conductor core 11 and the braided layer 13. The inclusion 12 is formed of, e.g., silicon, ETTE (polytetrafluoroethylene) or plural staple fiber yarns, etc. The inclusion 12 may be, e.g., a filling material in the form of sponge or liquid. Alternatively, the space between the conductor core 11 and the braided layer 13 may be a cavity, in other words, the inclusion 12 may not be provided between the conductor core 11 and the braided layer 13.

Figure 2:
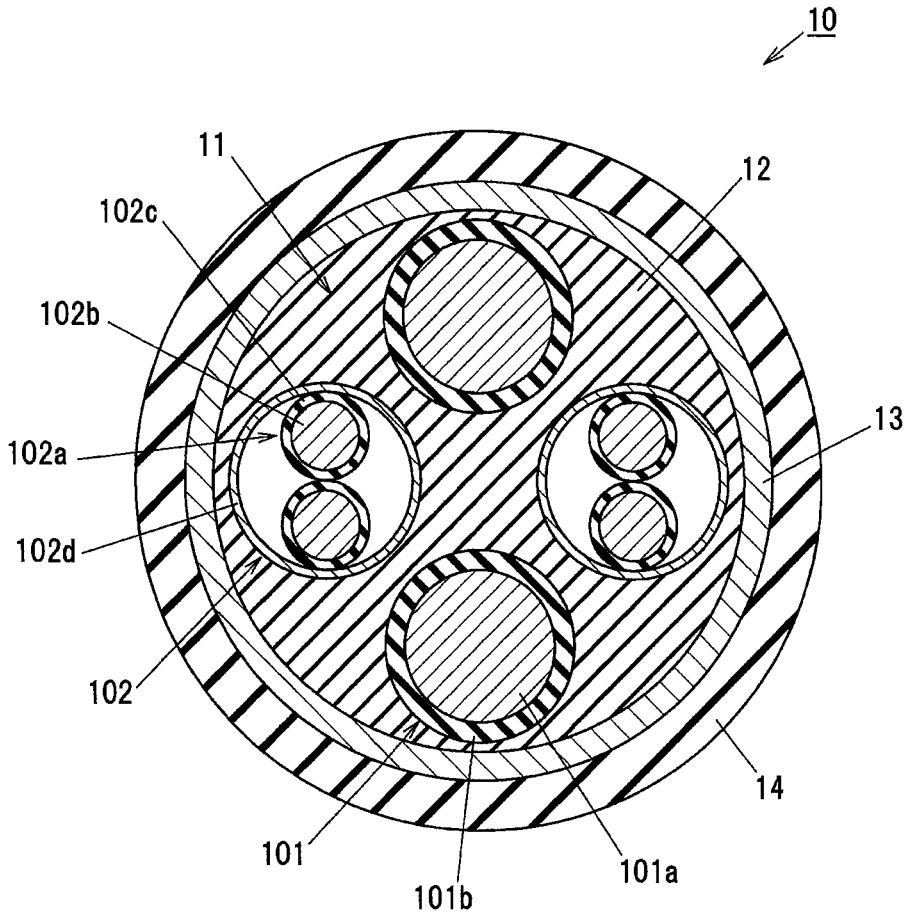
FIG. 2 is a cross sectional view of the electric cable shown in FIGS. 1A and 1B.

The conductor core 11 has conductors each covered with an insulation layer. In detail, as shown in the cross section of FIG. 2, the conductor core 11 is formed by twisting plural (two in FIG. 2) power transmission lines 101 and plural (two in FIG. 2) signal transmission lines 102. The power transmission line 101 is configured as an insulation-coated wire which is provided with a center conductor 101*a* formed by twisting plural conductor strands (not shown) together and an insulation layer 101*b* formed on the outer periphery of the center conductor 101*a*. The signal transmission line 102 is configured as a shielded twisted pair cable which is provided with a twisted wire formed by twisting two signal line cores 102*a* and a braided shield 102*d* formed on the outer periphery of the twisted wires. The signal line core 102*a* is composed of a center conductor 102*b* formed by twisting plural conductor strands (not shown) together and an insulation layer 102*c* formed on the outer periphery of the center conductor 102*b*. The braided shield 102*d* is formed by braiding plural metal wires to cover the outer periphery of the twisted wires. The conductor strand constituting the center conductors 101*a* and 102*b* is formed of, e.g., a Sn-containing copper alloy (Sn-0.15 to 0.7 wt % Cu alloy), etc. The insulation layers 101*b* and 102*c* are formed of, e.g., cross-linked polyethylene, etc.

In the first embodiment, the braided layer 13 is formed by braiding a first line group 13*a* and a second line group 13*b*. The first line group 13*a* is composed of first metal lines 16*m* and first fiber lines 15*f* arranged in a predetermined order along the longitudinal direction of the electric cable 10, and spirally wound around the outer periphery of the conductor core 11. The second line group 13*b* is composed of second metal lines 16*m*' and second fiber lines 15*f*' arranged in a predetermined order along the longitudinal direction of the electric cable 10, and spirally wound around the outer periphery of the conductor core 11 in the direction opposite to the first line group 13*a*.

Figure 1B:
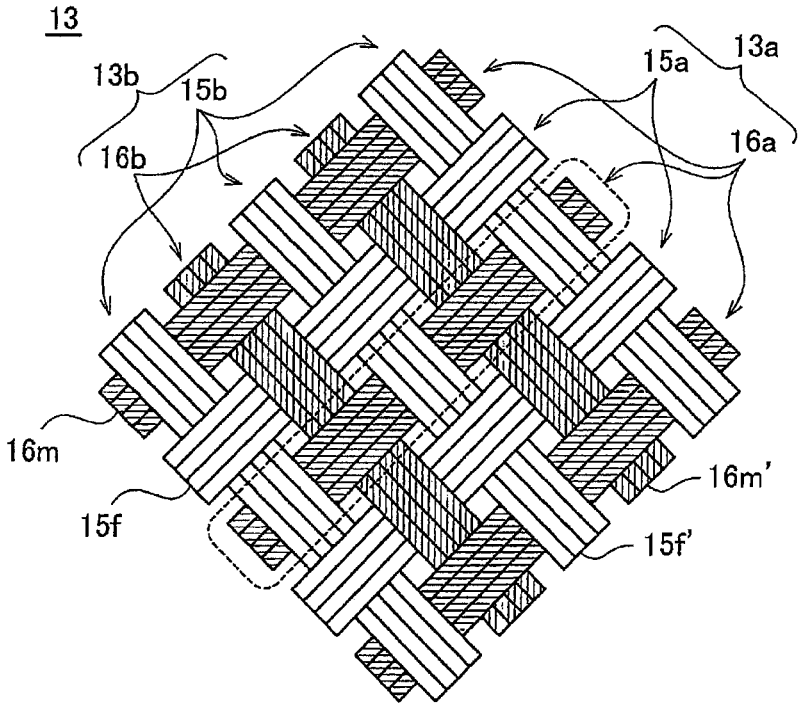
FIG. 1B is a partial enlarged view showing a braided layer in the electric cable of the first embodiment.

In detail, as shown in the partial enlarged view of FIG. 1B, the first line group 13*a* is configured as a first line bundle group provided with plural first metal line bundles 16*a* each formed in a belt shape by arranging plural (four in the first embodiment) first metal lines 16*m* in parallel and plural first fiber line bundles 15*a* each formed in a belt shape by arranging plural (four in the first embodiment) first fiber lines 15*f* in parallel. The first metal line bundles 16*a* and the first fiber line bundles 15*a* are alternately arranged along a longitudinal direction of the conductor core 11. The first line group 13*a* is composed of the alternately arranged line bundles spirally wound around the outer periphery of the conductor core 11. Although the first metal line bundle 16*a* composed of plural first metal lines 16*m* and the first fiber line bundle 15*a* composed of plural first fiber lines 15*f* are described as an example in the first embodiment, the invention is not limited thereto. For example, the first metal line bundle 16*a* may be constituted by a single first metal line 16*m* or the first fiber line bundle 15*a* may be constituted by a single first fiber line 15*f*.

Meanwhile, the second line group 13*b* is configured as a second line bundle group provided with plural second metal line bundles 16*b* each formed in a belt shape by arranging plural (four in the first embodiment) second metal lines 16*m*' in parallel and plural second fiber line bundles 15*b* each formed in a belt shape by arranging plural (four in the first embodiment) second fiber lines 15*f*' in parallel. The second metal line bundles 16*b* and the second fiber line bundles 15*b* are alternately arranged along the longitudinal direction of the conductor core 11. The second line group 13*b* is composed of the alternately arranged line bundles spirally wound around the outer periphery of the conductor core 11 in the direction opposite to the first line group 13*a*, i.e., in the direction opposite to the first metal line bundles 16*a* and the first fiber line bundles 15*a*. Although the second metal line bundle 16*b* composed of plural second metal lines 16*m*' and the second fiber line bundle 15*b* composed of plural second fiber lines 15*f*' are described as an example in the first embodiment, the invention is not limited thereto. For example, the second metal line bundle 16*b* may be constituted by a single second metal line 16*m*' or the second fiber line bundle 15*b* may be constituted by a single second fiber line 15*f*'.

The braided layer 13 is formed by alternately braiding (weaving) the line bundles (the first metal line bundles 16*a* and the first fiber line bundles 15*a*) constituting the first line group 13*a* as, e.g., warps and the line bundles (the second metal line bundles 16*b* and the second fiber line bundles 15*b*) constituting the second line group 13*b* as, e.g., wefts.

"Alternately braiding" mentioned above means that, for example, a first metal line bundle 16*a* (see in a dashed line of FIG. 1B) is braided so as to pass under a second fiber line bundle 15*b*, then pass above a second metal line bundle 16*b* adjacent thereto and then pass under another second fiber line bundle 15*b*.

By configuring as described above, i.e., by braiding the plural first metal line bundles 16*a* and the plural second metal line bundles 16*b* while simultaneously winding in the opposite directions to each other around the outer periphery of the conductor core 11, it is possible to repeatedly cross the plural metal line bundles 16*a* and 16*b* at a predetermined angle (included angle). This allows shielding performance of the braided layer 13, i.e., shielding properties (noise resistance) of the electric cable 10 to be improved. One of the reasons for this is that the crossed metal line bundles 16*a* and 16*b* cause, e.g., magnetic flux generated by a current flowing through the first metal line bundle 16*a* and magnetic flux generated by a current flowing through the second metal line bundle 16*b* to cancel each other.

If the crossing angle (included angle) between the first metal line bundle 16*a* and the second metal line bundle 16*b* is too small, i.e., if a relation between the metal line bundles 16*a*, 16*b* and the conductor core 11 is close to parallel, a decrease in the shielding performance of the braided layer 13, i.e., a decrease in the shielding properties of the electric cable 10 is likely to occur. It is possible to sufficiently increase the shielding performance of the braided layer 13 by adjusting the included angle between the first metal line bundle 16*a* and the second metal line bundle 16*b* to not less than 40°. It is possible to further increase the shielding performance of the braided layer 13 by adjusting the included angle between the first metal line bundle 16*a* and the second metal line bundle 16*b* to not less than 60°, preferably, not less than 80°.

On the other hand, if the crossing angle (included angle) between the first metal line bundle 16*a* and the second metal line bundle 16*b* is too large, i.e., if the relation between the metal line bundles 16*a*, 16*b* and the conductor core 11 is close to the right angle, a decrease in the speed of forming the braided layer 13 by braiding the metal line bundles 16*a* and 16*b*, i.e., a decrease in productivity of the electric cable 10 is likely to occur. It is possible to sufficiently increase the productivity of the electric cable 10 by adjusting the included angle between the first metal line bundle 16*a* and the second metal line bundle 16*b* to not more than 140°. It is possible to further increase the productivity of the electric cable 10 by adjusting the included angle between the first metal line bundle 16*a* and the second metal line bundle 16*b* to not more than 120°, preferably, not more than 100°.

Therefore, the angle (included angle) formed by crossing the first metal line bundle 16*a* and the second metal line bundle 16*b* is from 40° to 140°, preferably from 60° to 120°, more preferably from 80° to 100°.

As the first metal line 16*m* and the second metal line 16*m*', it is possible to use a solid metal strand or a bundle of metal strands, etc. The metal strand is not specifically limited and it is possible to suitably use a wire rod conventionally used as a constituent material of a braided shield layer. As the metal strand, it is possible to use, e.g., a Sn-plated copper wire and a copper alloy wire, etc. The cross sectional shape of the metal wire rod is not specifically limited and can be a circular shape, an oval shape or a rectangular shape etc.

As the first fiber line 15*f* and the second fiber line 15*f*', it is possible to use natural fibers such as cotton threads and silk threads, or artificial fibers. Especially artificial fibers can be suitably used due to less characteristic variation than natural fibers. Considering tensile strength, flex resistance and resistance to environment, etc., of the electric cable 10, it is preferable that the artificial fibers be materials proven for brake hose, e.g., polyvinyl alcohol, polyethylene terephthalate and polyethylene-2,6-naphthalate etc., and it is particularly preferable to use polyvinyl alcohol. The cross sectional shape of the fiber material is not specifically limited and can be a circular shape, an oval shape or a rectangular shape etc.

As a constituent material of a sheath 14, it is preferable to use a material having good resistances to heat, weather, oil and water, e.g., materials conventionally used as rubber materials for brake hose. A preferable constituent material of the sheath 14 is, e.g., a rubber material such as ethylene-propylene-diene rubber, styrene-butadiene rubber, butyl rubber, nitrile rubber or chloroprene rubber, and it is particularly preferable to use ethylene-propylene-diene rubber. In addition, these rubber materials may appropriately contain agents such as reinforcing agent, filler, plasticizer, softener, processing aid, activator, anti-scorching agent and antioxidant as long as the purpose and functions of the sheath 14 are not impaired. These rubber materials may further appropriately contain other polymers as long as the purpose and functions of the sheath 14 are not impaired.

The first embodiment achieves one or more effects described below.

(a) By winding the plural first metal line bundles 16*a* and the plural second metal line bundles 16*b* in the opposite directions to each other around the outer periphery of the conductor core 11, it is possible to repeatedly cross the plural metal line bundles 16*a* and 16*b* on the outer periphery of the conductor core 11 at a predetermined angle (included angle). As a result, it is possible to improve the shielding properties (noise resistance) of the electric cable 10.

Figure 4A:
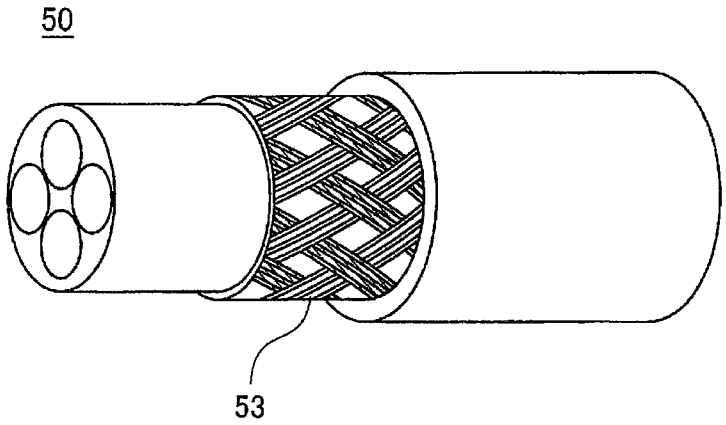
FIG. 4A is a perspective view showing a conventional electric cable.
Figure 4B:
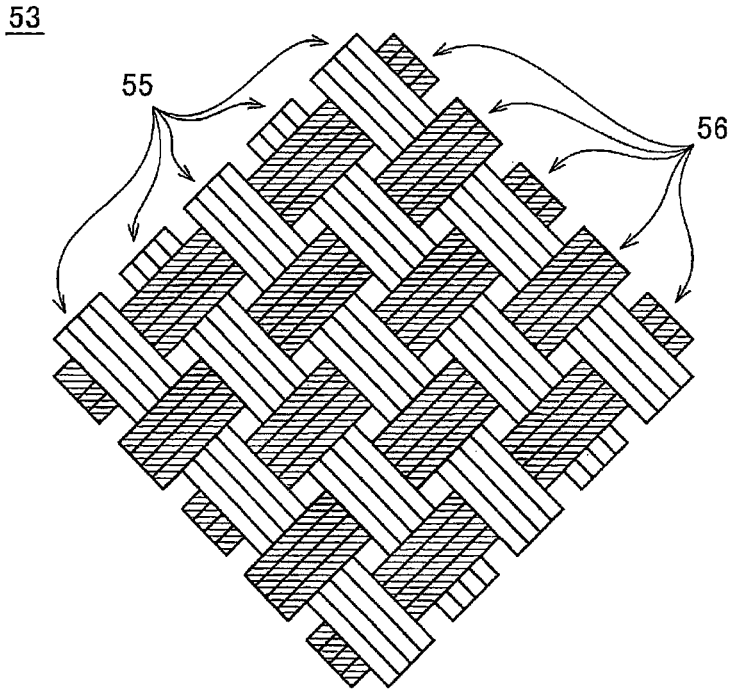
FIG. 4B is a partial enlarged view showing a hybrid braid layer of the conventional electric cable.

In FIG. 4, a configuration of a conventional electric cable is shown for reference. An electric cable 50 shown in FIG. 4 is provided with a hybrid braid layer 53 formed by winding plural metal line bundles 56 and plural fiber line bundles 55 in the opposite directions to each other around the outer periphery of the conductor core 11. The electric cable 50 shown in FIG. 4 has a shield layer (metal braid layer) formed by braiding metal wires and has better tensile strength and flex resistance but may have poorer shielding properties than general electric cables, i.e., electric cables not having a reinforcement layer formed by weaving fibers (a fiber braided layer). This is because the electric cable 50 shown in FIG. 4 is configured that all of the plural metal line bundles 56 are wound in the same direction and are thus not repeatedly crossed on the outer periphery of the conductor core. On the other hand, in the electric cable 10 of the first embodiment, the plural metal line bundles 16*a* and 16*b* are repeatedly crossed on the outer periphery of the conductor core 11 and this provides higher shielding properties than the electric cable 50 shown in FIG. 4.

(b) By winding the plural fiber line bundles 15*a* and 15*b* together with the metal line bundles 16*a* and 16*b* around the outer periphery of the conductor core 11 so as to be integrally woven into the braided layer 13, it is possible to obtain the braided layer 13 with excellent tensile strength. That is, the electric cable 10 in the first embodiment has higher tensile strength than general electric cables not having a reinforcement layer (fiber braided layer). Meanwhile, when fixing to an automobile, etc., the electric cable 10 is fixed by crimping metal fittings onto the outer periphery of the electric cable 10, i.e., onto the outer periphery of the sheath 14. At this time, the mesh of the braided layer 13 bites into the inner periphery of the sheath 14 and this allows a force of gripping the electric cable 10 to be improved. In addition, since the mesh of the braided layer 13 bites into the inner periphery of the sheath 14, elongation of the sheath 14 alone can be suppressed when the electric cable 10 is pulled.

(c) The braided layer 13 formed by integrally weaving the metal line bundles 16*a* and 16*b* and the fiber line bundles 15*a* and 15*b* allows the electric cable 10 to have excellent flex resistance. The following is the reason. If a two-layer structure composed of a shield layer (metal braid layer) and a reinforcement layer (fiber braided layer) which are described above is adopted, friction is likely to occur between these layers when the electric cable is bent and this results in that breaking of especially metal line is likely to occur. In contrast, in the first embodiment in which the metal line bundles 16*a* and 16*b* and the fiber line bundles 15*a* and 15*b* are integrated by weaving together, friction between the metal line bundles 16*a*, 16*b* and the fiber line bundles 15*a*, 15*b* does not occur and, as a result, breaking of the first metal lines 16*m* and the second metal lines 16*m*' can be suppressed.

(d) The braided layer 13 formed by integrally weaving the metal line bundles 16*a* and 16*b* and the fiber line bundles 15*a* and 15*b* allows the outer diameter of the electric cable 10 to be reduced and weight reduction to be realized. In other words, in the first embodiment, the two-layer structure composed of a shield layer (metal braid layer) and a reinforcement layer (fiber braided layer) is not adopted but the functions of these two layers (shielding and reinforcement) can be simultaneously realized only by the braided layer 13. Therefore, it is possible to simplify the structure of the electric cable 10 and thus to reduce the outer diameter thereof and to realize weight reduction.

(e) If the electric cable 10 is used for e.g. automobiles or industrial robots, the reliability and safety of devices installed therein can be greatly improved. For example, an electric cable wired under spring for electrically connecting a device (power source, inverter, control unit, etc.) arranged on an automobile body side and a device (in-wheel motor, electric brake, sensors, etc.) arranged on a component below a suspension spring in a hybrid car, etc., is fixed to an automobile body and to a movable component such as suspension arm by using plural metal fittings. Therefore, the electric cable wired under spring is required to have not only shielding properties but also flex resistance to withstand repetitive bending as well as tensile strength to withstand pulling force. The electric cable 10 in the first embodiment can have the improved shielding properties as well as the excellent tensile strength and flex resistance so as to be suitably used in such an environment.

Second Embodiment of the Invention

Figure 3A:
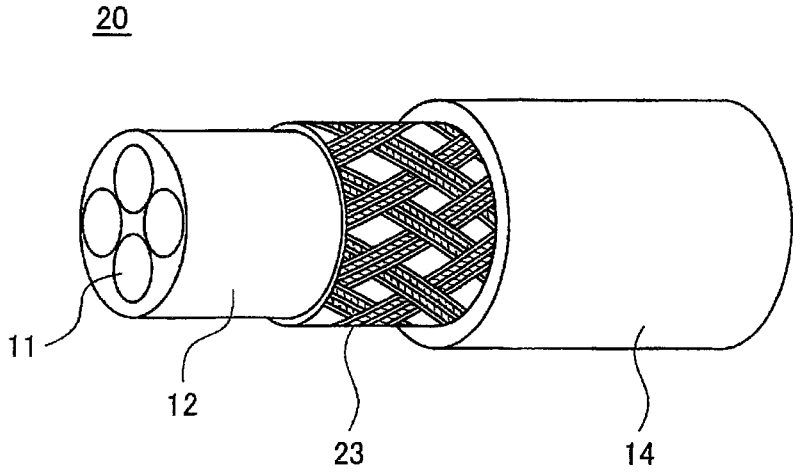
FIG. 3A is a perspective view showing an electric cable in a second embodiment of the invention.

An electric cable 20 in the second embodiment is different from the first embodiment only in the configuration of a braided layer 23. The remaining configuration is the same as the electric cable 10 in the first embodiment. The configuration of the braided layer 23 in the second embodiment will be described below in reference to FIGS. 3A and 3B.

In the second embodiment, the braided layer 23 is formed by braiding a first line group 23*a* and a second line group 23*b*. The first line group 23*a* is composed of plural first metal lines 16*m* and plural first fiber lines 15*f* arranged in a predetermined order along the longitudinal direction of the electric cable 20, and spirally wound around the outer periphery of the conductor core 11. The second line group 23*b* is composed of plural second metal lines 16*m*' and plural second fiber lines 15*f*' arranged in a predetermined order along the longitudinal direction of the electric cable 20, and spirally wound around the outer periphery of the conductor core 11 in the direction opposite to the first line group 23*a*.

Figure 3B:
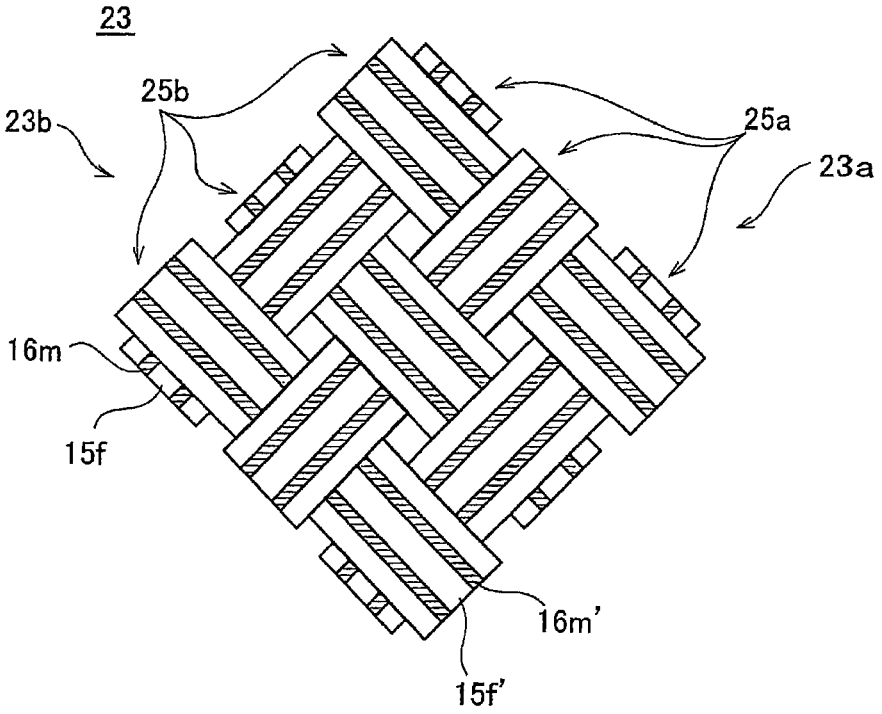
FIG. 3B is a partial enlarged view showing a braided layer in the electric cable of the second embodiment.

In detail, as shown in the partial enlarged view of FIG. 3B, the first line group 23*a* is configured as a first composite line bundle group provided with plural first composite line bundles 25*a* each formed in a belt shape by arranging plural first metal lines 16*m* and plural first fiber lines 15*f* (by alternately arranging three first metal lines 16*m* and two first fiber lines 15*f* in the second embodiment) in a predetermined order. The first line group 23*a* is composed of the plural first composite line bundles 25*a* aligned along the longitudinal direction of the conductor core 11 and spirally wound around the outer periphery of the conductor core 11. Although the first composite line bundle 25*a* composed of plural first metal lines 16*m* and plural first fiber lines 15*f* is described as an example in the second embodiment, the invention is not limited thereto. For example, the first composite line bundle 25*a* may have only one first metal line 16*m* or only one first fiber line 15*f*.

Meanwhile, the second line group 23*b* is configured as a second composite line bundle group provided with plural second composite line bundles 25*b* each formed in a belt shape by arranging plural second metal lines 16*m*' and plural second fiber lines 15*f*' (by alternately arranging three second metal lines 16*m*' and two second fiber lines 15*f*' in the second embodiment) in a predetermined order. The second line group 23*b* is composed of the plural second composite line bundles 25*b* aligned along the longitudinal direction of the conductor core 11 and spirally wound around the outer periphery of the conductor core 11 in the direction opposite to the first line group 23*a*, i.e., in the direction opposite to the first composite line bundle 25*a*. Although the second composite line bundle 25*b* composed of plural second metal lines 16*m*' and plural second fiber lines 15*f*' is described as an example in the second embodiment, the invention is not limited thereto. For example, the second composite line bundle 25*b* may have only one second metal line 16*m*' or only one second fiber line 15*f*'.

The braided layer 23 is formed by alternately braiding (weaving) the line bundles (the first composite line bundles 25*a*) constituting the first line group 23*a* as, e.g., warps and the line bundles (the second composite line bundles 25*b*) constituting the second line group 23*b* as, e.g., wefts. "Alternately braiding" mentioned above means that, for example, the middle of the three first composite line bundles 25*a* shown in FIG. 3B is braided so as to pass above a second composite line bundle 25*b*, then pass under another second composite line bundle 25*b* adjacent thereto, and then pass above still another second composite line bundle 25*b*.

By configuring as described above, i.e., by braiding the plural first composite line bundles 25*a* and the plural second composite line bundles 25*b* while simultaneously winding in the opposite directions to each other around the outer periphery of the conductor core 11, it is possible to repeatedly cross the plural composite line bundles 25*a* and 25*b*, i.e., to repeatedly cross the plural first metal lines 16*m* and the plural second metal lines 16*m*' included in the composite line bundles 25*a* and 25*b*, at a predetermined angle (included angle). This allows shielding performance of the braided layer 23, i.e., shielding properties (noise resistance) of the electric cable 20 to be improved. One of the reasons for this is that the crossed composite line bundles 25*a* and 25*b* cause, e.g., magnetic flux generated by a current flowing through (the first metal line 16*m* of) the first composite line bundle 25*a* and magnetic flux generated by a current flowing through (the second metal line 16*m*' of) the second composite line bundle 25*b* to cancel each other.

If the crossing angle (included angle) between the first composite line bundle 25*a* and the second composite line bundle 25*b* is too small, a decrease in the shielding properties of the electric cable 20 is likely to occur for the same reason as the first embodiment. It is possible to sufficiently increase the shielding properties of the electric cable 20 by adjusting the included angle between the composite line bundles 25*a* and 25*b* to not less than 40° and it is possible to further increase the shielding properties of the electric cable 20 by adjusting the included angle between the composite line bundles 25*a* and 25*b* to not less than 60°, preferably, not less than 80°.

On the other hand, if the crossing angle (included angle) between the first composite line bundle 25*a* and the second composite line bundle 25*b* is too large, a decrease in productivity of the electric cable 20 is likely to occur for the same reason as the first embodiment. It is possible to sufficiently increase the productivity of the electric cable 20 by adjusting the included angle between the composite line bundles 25*a* and 25*b* to not more than 140°. It is possible to further increase the productivity of the electric cable 20 by adjusting the included angle between the composite line bundles 25*a* and 25*b* to not more than 120°, preferably, not more than 100°.

Therefore, the angle (included angle) formed by crossing the first composite line bundle 25*a* and the second composite line bundle 25*b* is from 40° to 140°, preferably from 60° to 120°, more preferably from 80° to 100°.

The number, diameter and sequence, etc., of the first metal lines 16*m*, the second metal lines 16*m*', the first fiber lines 15*f* and the second fiber lines 15*f*' constituting the first composite line bundle 25*a* and the second composite line bundle 25*b* can be appropriately determined based on the specification required for the electric cable 20. For example, when the number of the first metal lines 16*m* and that of the second metal lines 16*m*' are increased respectively with respect to the number of the first fiber lines 15*f* and that of the second fiber lines 15*f*' in the composite line bundles 25*a* and 25*b*, it is possible to reduce impedance of the braided layer 23 and thus to improve the shielding performance, i.e., the shielding properties of the electric cable 20. On the other hand, when the number of the first fiber lines 15*f* and that of the second fiber lines 15*f*' are increased respectively with respect to the number of the first metal lines 16*m* and that of the second metal lines 16*m*' in the composite line bundles 25*a* and 25*b*, it is possible to improve tensile strength of the braided layer 23, i.e., tensile strength of the electric cable 20.

In this regard, it is preferable that the first fiber lines 15*f*, not the first metal lines 16*m*, be arranged at both ends in a width direction of the first composite line bundle 25*a*. In the same way, it is preferable that the second fiber lines 15*f*', not the second metal lines 16*m*', be arranged at both ends in a width direction of the second composite line bundle 25*b*. In addition, in this case, a diameter of the first fiber lines 15*f* arranged at the both ends in the width direction of the first composite line bundle 25*a* is preferably larger than a diameter of the first metal lines 16*m* arranged widthwise inside the first fiber lines 15*f*. In the same way, a diameter of the second fiber lines 15*f*' arranged at the both ends in the width direction of the second composite line bundle 25*b* is preferably larger than a diameter of the second metal lines 16*m*' arranged widthwise inside the second fiber lines 15*f*'. Here, "the width direction" of the composite line bundles 25*a* and 25*b* means a direction in which the lines (the first metal lines 16*m*, the second metal lines 16*m*', the first fiber lines 15*f* and the second fiber lines 15*f*') constituting the composite line bundles 25*a* and 25*b* are aligned in parallel and also a direction orthogonal to a longitudinal direction of the composite line bundles 25*a* and 25*b*.

In addition, when the first composite line bundle 25*a* includes plural first metal lines 16*m*, it is preferable that the first fiber line 15*f* be interposed each between the plural first metal lines 16*m*. In the same way, when the second composite line bundle 25*b* includes plural second metal lines 16*m*', it is preferable that the second fiber line 15*f*' be interposed each between the plural second metal lines 16*m*'. In other words, all the first metal lines 16*m* constituting the first composite line bundle 25*a* are sandwiched from both sides in the width direction of the composite line bundle 25*a* by the first fiber lines 15*f*. In the same way, all the second metal lines 16*m*' constituting the second composite line bundle 25*b* are sandwiched from both sides in the width direction of the composite line bundle 25*b* by the second fiber lines 15*f*'.

The second embodiment achieves one or more effects described below.

(a) By winding the plural composite line bundles 25*a* and the plural composite line bundles 25*b* in the opposite directions to each other around the outer periphery of the conductor core 11, it is possible to repeatedly cross the plural composite line bundles 25*a* and 25*b* on the outer periphery of the conductor core 11 at a predetermined angle (included angle). As a result, it is possible to improve the shielding properties (noise resistance) of the electric cable 20. In other words, in the electric cable 20 of the second embodiment, the plural first metal lines 16*m* and the plural second metal lines 16*m*' are repeatedly crossed on the outer periphery of the conductor core 11 and this provides higher shielding properties than the electric cable 50 shown in FIG. 4.

(b) Since the braided layer 23 is formed by braiding the composite line bundles 25*a* and 25*b*, i.e., since the first metal lines 16*m*, the second metal lines 16*m*', the first fiber lines 15*f* and the second fiber lines 15*f*' are integrally woven in the braided layer 23, it is possible to impart excellent tensile strength to the braided layer 23. That is, the electric cable 20 in the second embodiment has higher tensile strength than general electric cables not having a reinforcement layer (fiber braided layer). In addition, when fixing the electric cable 20 to an automobile, etc., by crimping the outer periphery of the sheath 14, the mesh of the braided layer 23 bites into the inner periphery of the sheath 14 and this allows a force of gripping the electric cable 20 to be improved. In addition, since the mesh of the braided layer 23 bites into the inner periphery of the sheath 14, elongation of the sheath 14 alone can be suppressed when the electric cable 20 is pulled.

(c) The braided layer 23 formed by braiding the composite line bundles 25*a* and 25*b*, i.e., the braided layer 23 formed by integrally weaving the first metal lines 16*m*, the second metal lines 16*m*', the first fiber lines 15*f* and the second fiber lines 15*f*, allows flex resistance of the electric cable 20 to be improved. That is, in the second embodiment, it is easy to avoid friction between the first metal lines 16*m*, the second metal lines 16*m*', the first fiber lines 15*f* and the second fiber lines 15*f*' as compared to the case where the two-layer structure composed of a shield layer (metal braid layer) and a reinforcement layer (fiber braided layer) is adopted, which results in that breaking of the first metal lines 16*m* and the second metal lines 16*m*' can be suppressed.

Especially since the first fiber lines 15*f* and the second fiber lines 15*f*', not the first metal lines 16*m* and the second metal lines 16*m*', are arranged at the both ends in the width direction of the composite line bundles 25*a* and 25*b*, it is possible to obtain the electric cable 20 with excellent flex resistance. In general, friction is likely to occur between the both widthwise ends of the first composite line bundle 25*a* and the main surface of the second composite line bundle 25*b* crossing therewith when the electric cable 20 is bent. Likewise, friction is likely to occur also between the both widthwise ends of the second composite line bundle 25*b* and the main surface of the first composite line bundle 25*a* crossing therewith. Therefore, if the first metal lines 16*m* and the second metal lines 16*m*' are arranged at the both ends in the width direction of the composite line bundles 25*a* and 25*b*, the first metal lines 16*m* and the second metal lines 16*m*' arranged at the both ends in the width direction are likely to be broken due to friction. In contrast, when the first fiber lines 15*f* and the second fiber lines 15*f*' are arranged at the both ends in the width direction of the composite line bundles 25*a* and 25*b*, the first metal lines 16*m* and the second metal lines 16*m*' arranged widthwise inside the first fiber lines 15*f* and the second fiber lines 15*f*' are protected respectively by the first fiber lines 15*f* and the second fiber lines 15*f*' and, as a result, breaking of the first metal lines 16*m* and the second metal lines 16*m*' due to friction can be further suppressed.

In addition, since the diameter of the first fiber lines 15*f* and the second fiber lines 15*f*' arranged at the both ends in the width direction of the composite line bundles 25*a* and

25*b* is larger than the diameter of the first metal lines 16*m* and the second metal lines 16*m*' arranged widthwise inside such first fiber lines 15*f* and second fiber lines 15*f*', it is possible to further improve flex resistance of the electric cable 20. In other words, by configuring the first fiber lines 15*f* and the second fiber lines 15*f* arranged at the both ends in the width direction to have a diameter as described above, the first metal lines 16*m* and the second metal lines 16*m*' arranged widthwise inside such first fiber lines 15*f* and second fiber lines 15*f*' are reliably protected by the first fiber lines 15*f* and the second fiber lines 15*f*'. As a result, breaking of the first metal lines 16*m* and the second metal lines 16*m*' due to friction can be suppressed more reliably. If a material with good slipping properties, e.g., Teflon (trademark), etc., is used to form the first fiber lines 15*f* and the second fiber lines 15*f*' arranged at the both ends in the width direction of the composite line bundles 25*a* and 25*b*, breaking of wires due to friction can be suppressed further reliably and it is thus possible to further improve flex resistance of the electric cable 20.

In addition, when the composite line bundles 25*a* and 25*b* respectively include the plural first metal lines 16*m* and the plural second metal lines 16*m*', it is possible to further improve flex resistance of the electric cable 20 by interposing the first fiber lines 15*f* and the second fiber lines 15*f*' respectively between the plural first metal lines 16*m* and between the plural second metal lines 16*m*'. In other words, by sandwiching each metal line 16*m* and each second metal line 16*m*' from both sides respectively by the first fiber lines 15*f* and the second fiber lines 15*f*', the first fiber lines 15*f* and the second fiber lines 15*f*' act as a buffer (cushioning material) to reduce pressure applied to the first metal lines 16*m* and the second metal lines 16*m*' when the electric cable 20 is bent. As a result, breaking of the first metal lines 16*m* and the second metal lines 16*m*' due to friction can be suppressed.

(d) The braided layer 23 formed by braiding the composite line bundles 25*a* and 25*b*, i.e., the braided layer 23 formed by integrally weaving the first metal lines 16*m*, the second metal lines 16*m*', the first fiber lines 15*f* and the second fiber lines 15*f*', allows the outer diameter of the electric cable 20 to be reduced and weight reduction to be realized. In other words, in the second embodiment, since the functions of the two layers (shielding and reinforcement) can be simultaneously realized only by the braided layer 23, it is possible to simplify the structure of the electric cable 20 and thus to reduce the outer diameter thereof and to realize weight reduction.

(e) The electric cable 20 in the second embodiment has the improved shielding properties while being excellent in tensile strength and flex resistance, and thus can be suitably used as, e.g., an electric cable for automobile and industrial robot in the same manner as the electric cable 10 in the first embodiment. Especially when the electric cable 20 in the second embodiment is used as an electric cable which is wired under spring and is thus required to have all of shielding properties, flex resistance and tensile strength, it is possible to greatly improve reliability and safety of hybrid car, etc.

Other Embodiments of the Invention

Although the embodiments of the invention have been specifically described, the invention is not intended to be limited to the embodiments, and the various kinds of change can be made without departing from the gist thereof.

Although the example in which the first fiber lines 15*f* and the second fiber lines 15*f*' are arrange at the both ends in the width direction of the composite line bundles 25*a* and 25*b* has been described in the embodiment, the invention is not limited thereto. For example, only one of the composite line bundles 25*a* and 25*b* may be configured as such. It is possible to improve flex resistance of the electric cable 20 also in this case. However, it is more preferable that both of the composite line bundles 25*a* and 25*b*, not only one of them, be configured as described above since it is easy to improve the flex resistance of the electric cable 20.

In addition, although the example in which the diameter of the first fiber lines 15*f* and the second fiber lines 15*f*' arranged at the both ends in the width direction of the composite line bundles 25*a* and 25*b* is larger than the diameter of the first metal lines 16*m* and the second metal lines 16*m*' arranged widthwise inside such first fiber lines 15*f* and second fiber lines 15*f* has been described in the embodiment, the invention is not limited thereto. For example, even when only one of the composite line bundles 25*a* and 25*b* is configured as such, it is possible to improve flex resistance of the electric cable 20. However, it is more preferable that both of the composite line bundles 25*a* and 25*b*, not only one of them, be configured as described above since it is easy to improve since the flex resistance of the electric cable 20.

In addition, although the composite line bundles 25*a* and 25*b* which respectively include the plural first metal lines 16*m* and the plural second metal lines 16*m*' so that the first fiber lines 15*f* and the second fiber lines 15*f*' are interposed respectively between the plural first metal lines 16*m* and between the plural second metal lines 16*m*' have been described as an example in the embodiment, the invention is not limited thereto. For example, even when only one of the composite line bundles 25*a* and 25*b* is configured as such, it is possible to improve flex resistance of the electric cable 20. However, it is more preferable that both of the composite line bundles 25*a* and 25*b*, not only one of them, be configured as described above since it is easy to improve the flex resistance of the electric cable 20.

In addition, although the example in which the conductor core 11 is formed by twisting two power transmission lines 101 and two signal transmission lines 102 has been described in the embodiments, the invention is not limited thereto. The number of the power transmission lines 101 and that of the signal transmission lines 102 may be one, or three or more. Alternatively, the power transmission line(s) 101 and the signal transmission line(s) 102 may not be twisted. In addition, the power transmission line 101 is not limited to a single insulation-coated wire and may be, e.g., a litz wire obtained by twisting plural insulation-coated wires together. Similarly, the signal transmission line 102 is not limited to a shielded twisted pair cable and may be an unshielded twisted pair cable or a coaxial cable. In addition, such several types of power transmission lines and signal transmission lines may be combined, and electric wires other than power transmission lines and signal transmission lines may be included.

What is claimed is:

1. An electric cable, comprising:

a conductor core comprising conductors each covered with an insulation layer; and a braided layer formed on an outer periphery of the conductor core, wherein the braided layer comprises a braid of a first line group and a second line group, wherein the first line group comprises first metal lines and first fiber lines arranged along a longitudinal direction of the conductor core and is spirally wound around the outer periphery of the conductor core, and wherein the second line group comprises second metal lines and second fiber lines arranged along the longitudinal direction of the conductor core and is spirally wound around the outer periphery of the conductor core in a direction opposite to the first line group, wherein the first line group further comprises a first composite line bundle comprising a plurality of first composite line bundles arranged along the longitudinal direction of the conductor core and is spirally wound around the outer periphery of the conductor core, the first composite line bundle being a bundle formed by aligning a plurality of the first metal lines and a plurality of the first fiber lines, wherein the second line group further comprises a second composite line bundle that comprises a plurality of second composite line bundles arranged along the longitudinal direction of the conductor core and is spirally wound around the outer periphery of the conductor core in the direction opposite to the first composite line bundle, the second composite line bundle being a bundle formed by aligning a plurality of the second metal lines and a plurality of the second fiber lines, wherein the plurality of the first metal lines and the plurality of the first fiber lines are arranged in parallel in a width direction of the first composite line bundle, and wherein the plurality of the second metal lines and the plurality of the second fiber lines are arranged in parallel in a width direction of the second composite line bundle.

2. The electric cable according to claim 1, wherein a diameter of the first fiber lines arranged at the both ends in the width direction of the first composite line bundle is larger than a diameter of the first metal lines arranged widthwise inside the first fiber lines, and wherein a diameter of the second fiber lines arranged at the both ends in the width direction of the second composite line bundle is larger than a diameter of the second metal lines arranged widthwise inside the second fiber lines.

3. The electric cable according to claim 1, wherein the first composite line bundle further comprises a plurality of the first metal lines and the first fiber lines are interposed therebetween, and wherein the second composite line bundle comprises a plurality of the second metal lines and the second fiber lines are interposed therebetween.

4. The electric cable according to claim 1, wherein an angle formed between the first metal lines and the second metal lines is between 40° and 140°.

5. The electric cable according to claim 4, wherein an angle formed between the first metal lines and the second metal lines is between 60° and 120°.

6. The electric cable according to claim 5, wherein an angle formed between the first metal lines and the second metal lines is between 80° and 100°.

* * * * *